US010986437B1

(12) United States Patent
Pan et al.

(10) Patent No.: US 10,986,437 B1
(45) Date of Patent: Apr. 20, 2021

(54) MULTI-PLANE MICROPHONE ARRAY

(71) Applicant: Amazon Technologies, Inc., Seattle, WA (US)

(72) Inventors: Guangdong Pan, Quincy, MA (US); Chad Jackman, San Jose, CA (US); Wontak Kim, Watertown, MA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/014,275

(22) Filed: Jun. 21, 2018

(51) Int. Cl.

| | |
|---|---|
| ***H04R 1/22*** | (2006.01) |
| ***H04R 1/40*** | (2006.01) |
| ***H04R 1/32*** | (2006.01) |
| ***H04R 1/08*** | (2006.01) |
| ***H04R 1/28*** | (2006.01) |

(52) U.S. Cl.
CPC ..... *H04R 1/222* (2013.01); *H04R 1/083* (2013.01); *H04R 1/2869* (2013.01); *H04R 1/326* (2013.01); *H04R 1/406* (2013.01)

(58) Field of Classification Search
CPC ..... H04R 1/083; H04R 1/222; H04R 1/2869; H04R 1/326; H04R 1/406; H04R 2410/021; H04R 2430/20; H04R 2430/21; H04R 2430/23
USPC ..... 381/92
See application file for complete search history.

(56) References Cited

U.S. PATENT DOCUMENTS

| | | | | |
|---|---|---|---|---|
| 9,721,582 | B1 * | 8/2017 | Huang | G10L 21/0216 |
| 9,743,204 | B1 * | 8/2017 | Welch | H04R 29/005 |
| 2017/0140771 | A1 * | 5/2017 | Taniguchi | G10L 15/05 |
| 2019/0132685 | A1 * | 5/2019 | Skoglund | G10L 21/02 |

* cited by examiner

*Primary Examiner* — Alexander Krzystan
(74) *Attorney, Agent, or Firm* — Pierce Atwood LLP

(57) ABSTRACT

A beamformer system isolates a desired direction of an audio signal received from a first microphone array disposed on a first plane of the system and a second microphone array disposed on a second plane of the system. A spatial covariance matrix (SCM) defines the spatial covariance between pairs of microphones. A diagonal of the SCM is varied based on the placement of the microphones; values corresponding to one microphone array are increased, and values corresponding to the other microphone array are decreased.

20 Claims, 19 Drawing Sheets

MULTI-PLANE MICROPHONE ARRAY

BACKGROUND

In audio systems, beamforming refers to techniques that are used to isolate audio from a particular direction. Beamforming may be particularly useful when filtering out noise from non-desired directions. Beamforming may be used for various tasks, including isolating voice commands to be executed by a speech-processing system.

BRIEF DESCRIPTION OF DRAWINGS

For a more complete understanding of the present disclosure, reference is now made to the following description taken in conjunction with the accompanying drawings.

DETAILED DESCRIPTION

Beamforming systems isolate audio associated with an acoustic event, such as an utterance, from a particular direction in a multi-directional audio capture system. As the terms are used herein, an azimuth direction refers to a direction in the XY plane with respect to the system, and elevation refers to a direction in the Z plane with respect to the system. One technique for beamforming involves boosting audio received from a desired azimuth direction and/or elevation while dampening audio received from a non-desired azimuth direction and/or non-desired elevation. Existing beamforming systems, however, may perform poorly when audio associated with an acoustic event is received from a particular azimuth direction and/or elevation; in these systems, the audio may not be boosted enough to accurately perform additional processing associated with the acoustic event, such as automatic speech recognition (ASR) or speech-to-text processing. Further, particular configurations of microphones for certain devices may perform better than others for different tasks, and beamforming techniques may be customized for particular microphone configurations/desired uses of resulting audio data.

In various embodiments of the present disclosure, a beamforming system includes a first microphone array disposed on a first plane or surface of a device and a second microphone array disposed on a second plane or surface of the device that differs from the first plane. For example, the first surface may be one that is disposed wholly or partially facing a speaker, and the second surface may be one that is wholly or partially facing away from the speaker or sideways to the speaker.

Figure 1:
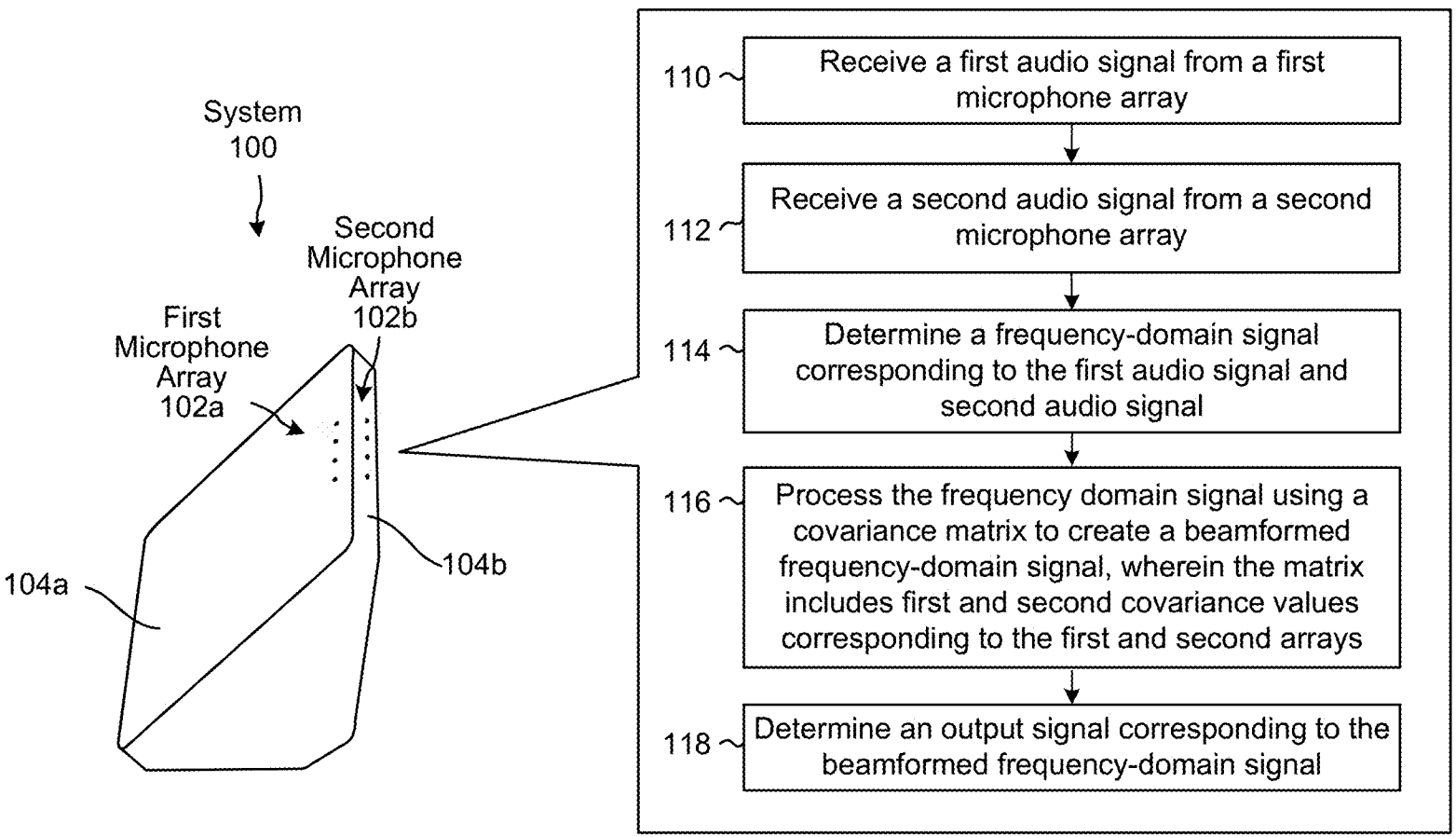
FIG. 1 illustrates a system for beamforming an audio signal received from first and second microphone arrays using a covariance matrix according to embodiments of the present disclosure.

As shown in FIG. 1, a system 100 may include a first microphone array 102*a* disposed on a first plane or surface 104*a* and a second microphone array 102*b* disposed on a second plane or surface 104*b*. The first plane 104*a* may be disposed at a 90° angle (i.e., orthogonal to) relative to the second plane 104*b*; the present disclosure is not limited to only this angular relationship, however and any relative angular position of the planes 104*a*, 104*b* (e.g., 45°, 70°, 110°, or 135°) is within its scope. As disclosed herein, the first microphone array 102*a* may include a first four microphones and the second microphone array 102*b* may include a second four microphones; the present disclosure is not limited, however, to only this number, and the first microphone array 102*a* and the second microphone array 102*b* may each contain any number, including different numbers, of microphones. Additional microphone arrays disposed on additional planes are within the scope of the present disclosure. As further disclosed herein, the first microphone array 102*a* is disposed on a front-facing plane 104*a* and the second microphone array 102*b* is disposed on a top-, side- and/or rear-facing plane 104*b*; the present disclosure is not limited, however, to only these placements, and the first microphone array 102*a* and the second microphone array 102*b* may be disposed on any plane(s) of the system 100. The shape or housing of the system 100 is similarly not limited to only the shape or housing disclosed herein and may be any shape.

A covariance matrix may be created to define the spatial relationships between the microphones with respect to how each microphone detects audio relative to other microphones; this covariance matrix may include a number of covariance values corresponding to each pair of microphones. The covariance matrix is a matrix whose covariance value in the i, j position represents the covariance, such as spatial covariance, between the $i^{th}$ and $j^{th}$ elements of the microphone arrays. If the greater values of one variable mainly correspond with the greater values of the other variable, and the same holds for the lesser values, (i.e., the variables tend to show similar behavior), the covariance is positive. In the opposite case, when the greater values of one variable mainly correspond to the lesser values of the other, (i.e., the variables tend to show opposite behavior), the covariance is negative. In some embodiments, the covariance matrix is a spatial covariance matrix (SCM).

For example, a covariance value corresponding to the fourth row and fifth column of the matrix corresponds to the relationship between the fourth and fifth microphones of the array. In various embodiments, the values of the diagonal of the covariance matrix differ for the first and second microphone arrays; the covariance values of the diagonal corresponding to the first microphone array may, for example, be greater than the covariance values of the diagonal corresponding to the second microphone array. When input audio is processed with the covariance matrix, an utterance from an azimuth direction and/or elevation is more clearly distinguished and better able to be processed with, for example, ASR or speech-to-text processing.

For example, a covariance matrix for a three-microphone system may be expressed as an N×M matrix, where N represents the time domain (or, e.g., a single frame thereof) and M represents frequency bins. This covariance matrix may be expressed as:

$$R_{XX}=E[XX^H] \tag{1}$$

Expressing Equation (1) for a Three-Microphone System Yields, for a Given Frequency Bin M:

$$R_{XX} = E\begin{pmatrix} x_1x_1^* & x_1x_2^* & x_1x_3^* \\ x_2x_1^* & x_2x_2^* & x_1x_1^* \\ x_2x_1^* & x_3x_2^* & x_3x_3^* \end{pmatrix} \tag{2}$$

A plurality of $R_{XX}$ matrices may be computed for each of a corresponding plurality of frequency bins M. Each $R_{XX}$ matrix may be computed via estimation, for example by exponential averaging, in accordance with the below equation:

$$\tilde{R}_{XX}[n]=\alpha\tilde{R}_{XX}[n-1]+(1-\alpha)x[n]x^H[n] \tag{3}$$

In the above equation, $\alpha$ is between 0 and 1.

In various embodiments, the system 100 receives (110) a first audio signal from the first microphone array 102*a* disposed on the first plane 104*a* and receives (112) a second audio signal from the second microphone array 102*b* disposed on the second plane 104*b*. The first audio signal and the second audio signal may include a representation of an acoustic event, such as an utterance. As used herein, an acoustic event is an event that causes audio to be created. The audio may be detected by one or more microphones, which then create audio data corresponding to the acoustic event. The system 100 determines (114) a first frequency-domain signal corresponding to the first audio signal and the second audio signal by using, for example, a Fourier transform. As described in greater detail below, the first frequency-domain signal may correspond to a first frequency range, also referred to herein as a frequency sub-band, that corresponds to a subset of a larger range of audio frequencies. Other frequency-domain signals corresponding to other frequency ranges may be determined. The system 100 processes (116) the frequency-domain signal using a covariance matrix to create a beamformed frequency-domain signal; as explained in greater detail below, covariance values corresponding to each of the first and second microphone arrays 102*a*, 102*b* may vary. The system 100 determines (118) an output signal corresponding to the beamformed frequency-domain signal.

Figure 2:
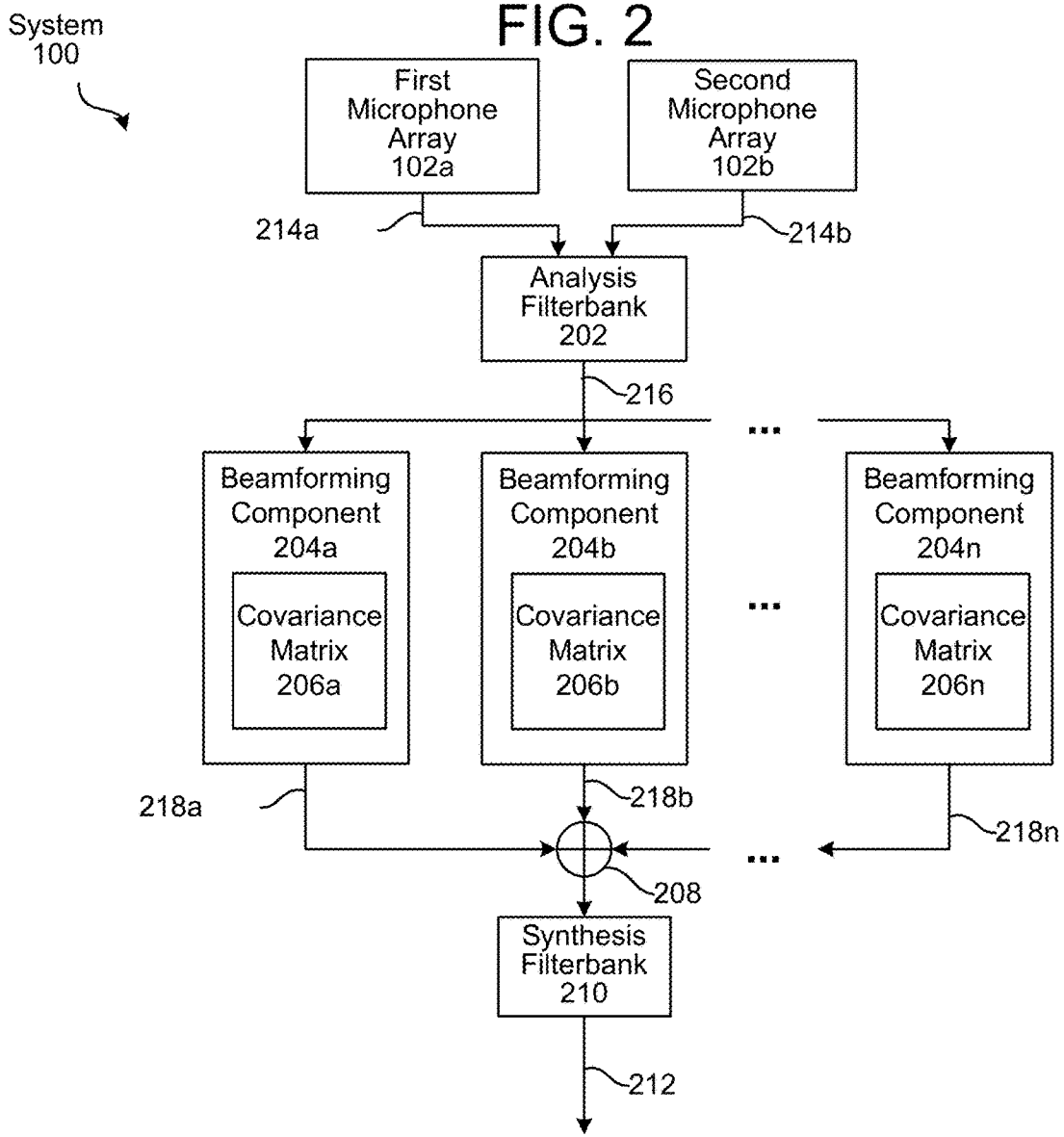
FIG. 2 illustrates components of a system for beamforming an audio signal received from first and second microphone arrays using a weighted covariance matrix according to embodiments of the present disclosure.

FIG. 2 illustrates components of the system 100 in greater detail. An analysis filterbank 202 receives the first audio signal 214*a* from the first microphone array 102*a* and the second audio signal 214*b* from the second microphone array 102*b*. Each audio signal 214*a*/214*b* may be a single audio signal from one microphone or a plurality of audio signals corresponding to one or more microphones. The analysis filterbank 202 may include hardware, software, and/or firmware for processing audio signals and may convert the first and/or second audio data 214*a*/214*b* from the time domain into the frequency/sub-band domain. The analysis filterbank 202 may thus create one or more frequency-domain signals 216; the frequency-domain signals 216 may correspond to multiple adjacent frequency bands. The analysis filterbank 202 may include, for example, a uniform discrete Fourier transform (DFT) filterbank, a Fast Fourier Transform filterbank, or any other component that converts the time-domain input audio data 102*a*/102*b* into one or more frequency-domain signals 216. The frequency-domain signal 216 may incorporate audio signals corresponding to multiple different microphones as well as different sub-bands (i.e., frequency ranges) as well as different frame indices (i.e., time ranges). The analysis filterbank 202 may create the frequency-domain signal by combining (e.g., adding) the time-domain signals 214*a*, 214*b* and then applying the DFT, FFT, or other such transform to the combined time-domain signal; the analysis filterbank may also apply the DFT, FFT, or other such transform to each audio signal 214*a*, 214*b* and then combine the results to create the frequency domain signal 216. Any method of creating one or more frequency-domain signals from a plurality of time-domain signals is, however, within the scope of the present disclosure.

The frequency-domain signal(s) 216 created by the analysis filterbank 202 is/are received by one or more beamforming components 204*a*, 204*b*, . . . 204*n*, collectively referred to herein as beamforming components 204. In various embodiments, the number of beamforming components 204 corresponds to the number of frequency sub-bands of the frequency-domain signal 216; if, for example, the analysis filterbank 202 breaks the audio signals 102*a*/102*b* into ten different frequency sub-bands, the system includes ten beamforming components 204 to process each of the ten different frequency sub-bands.

In various embodiments, a sound (such as an utterance spoken by a user) may be received by more than one microphone, such as by a first microphone of the first microphone array 102*a* and by a second microphone of the second microphone array 102*b*. Because the microphones are disposed at different locations on a plane, or on different planes, each microphone may capture a different version of the sound; each version may differ in one or more properties or attributes, such as volume, time delay, frequency spectrum, power level, amount and type of background noise, or any other similar factor. Each beamforming component 204 may utilize these differences to isolate and boost sound from a particular azimuth direction and/or elevation while suppressing sounds from other azimuth directions and/or elevation. Any particular system and method for beamforming is within the scope of the present invention.

In various embodiments, the beamforming component is a minimum variance distortionless response (MVDR) beamformer. A MVDR beamformer may apply filter weights w to the frequency-domain signal 216 in accordance with the following equation:

$$w = \frac{Q^{-1}d}{d^H Q^{-1} d} \tag{4}$$

In Equation (1), Q is the covariance matrix and may correspond to the cross-power spectral density (CPSD) of a noise field surrounding the system 100, and d is a steering vector that corresponds to a transfer function between the system 100 and a target source of sound located at a distance (e.g., two meters) from the system 100. The covariance matrix is explained in greater detail below.

Each beamforming component 204 may create a beamformed frequency-domain signal 218 that, as described above, emphasizes or boosts audio from a particular azimuth direction and/or elevation for, in some embodiments, the frequency sub-band associated with each beamforming component 204. The beamformed frequency-domain signal(s) 218 may be combined, if necessary, using a summation component 208. Once the combined signal is determined, it is sent to synthesis filterbank 210 which converts the combined signal into time-domain audio output data 212 which may be sent to a downstream component (such as a speech processing system) for further operations (such as determining speech processing results using the audio output data). The synthesis filterbank 210 may include an inverse FFT function for synthesizing the time-domain audio output data; any system or method for creating time-domain signals from frequency-domain signals is, however, within the scope of the present disclosure.

Figure 3A:
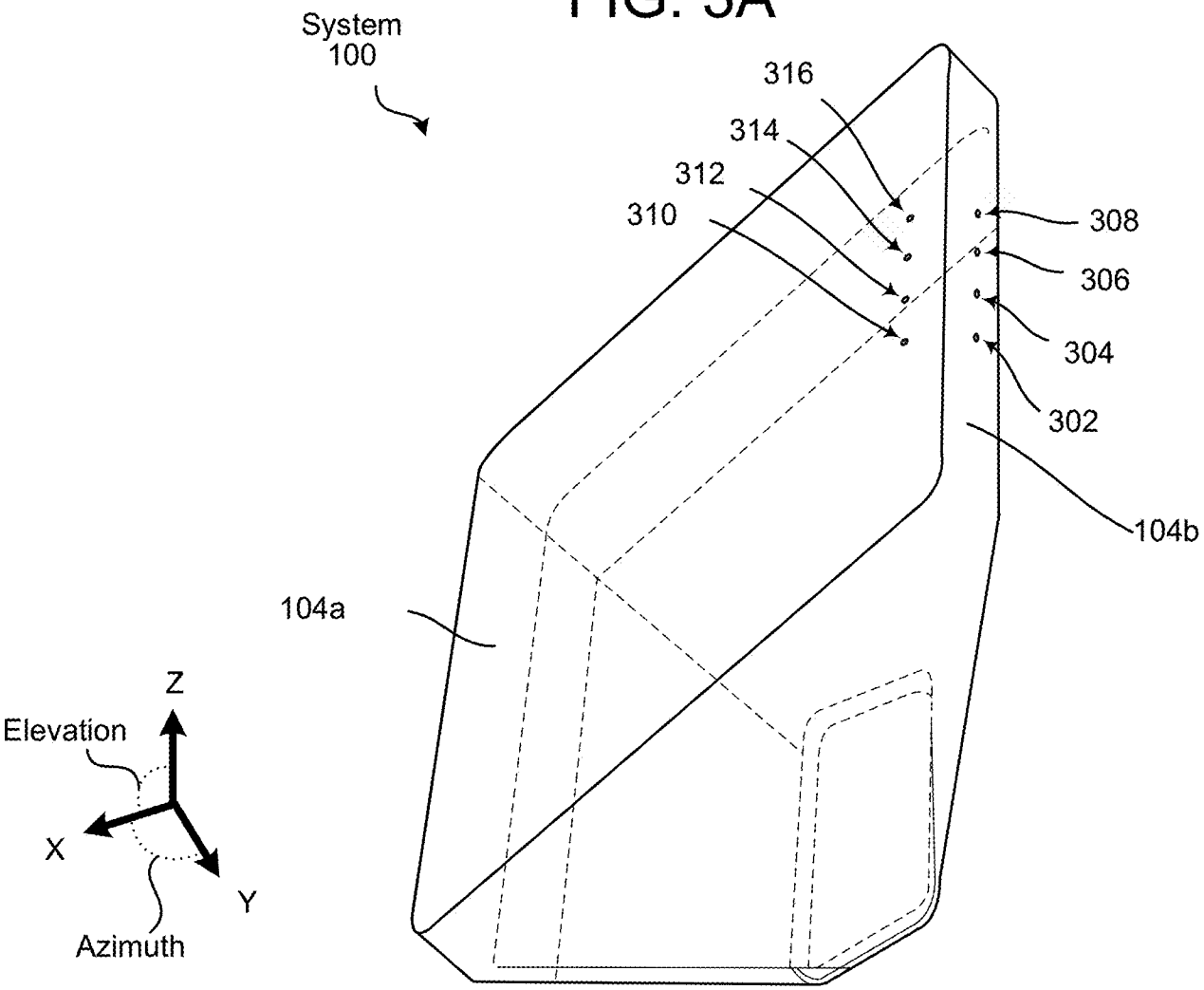
FIGS. 3A-3C illustrate positions of microphones in the first and second microphone arrays according to embodiments of the present disclosure.
Figure 3B:
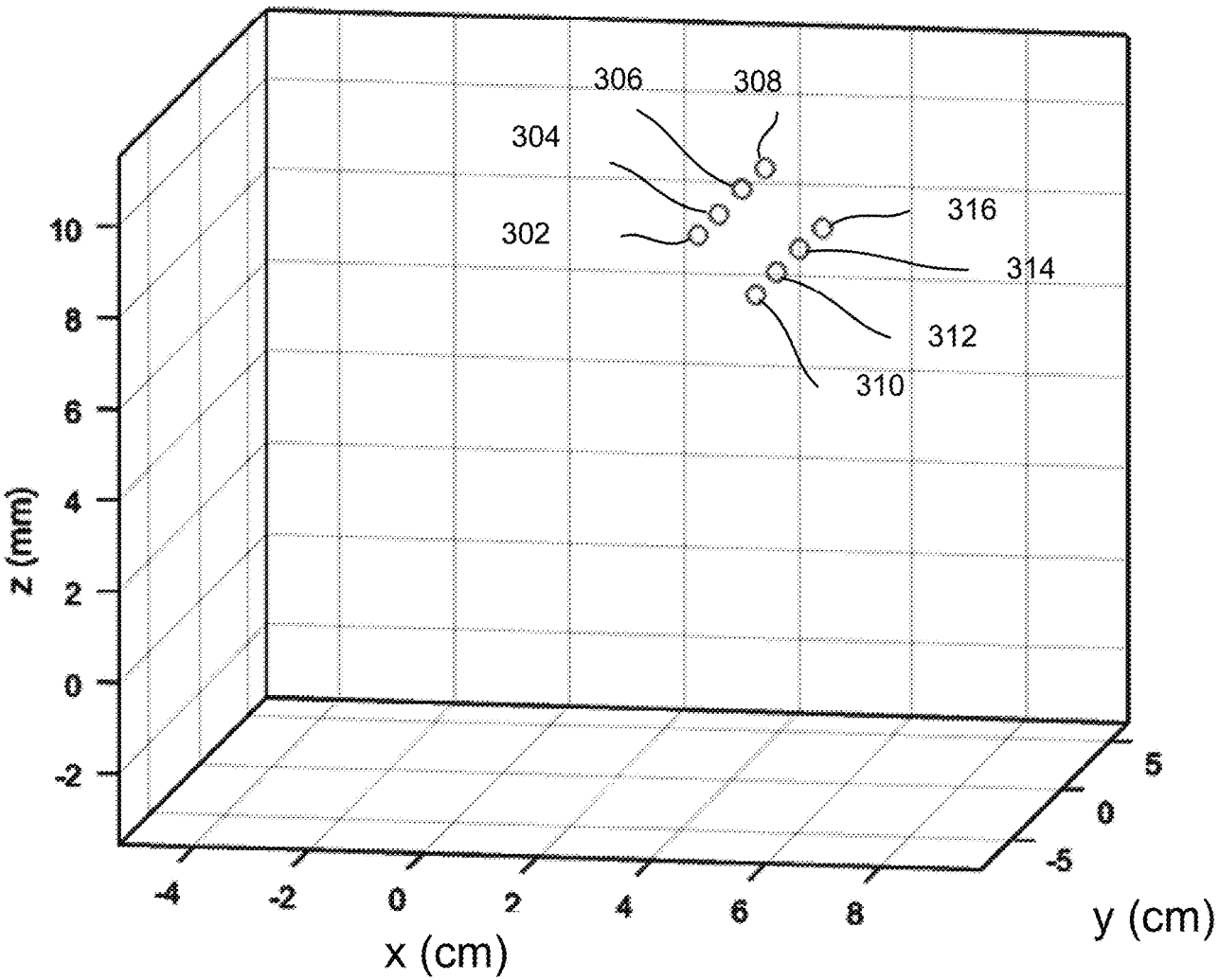
Figure 3C:
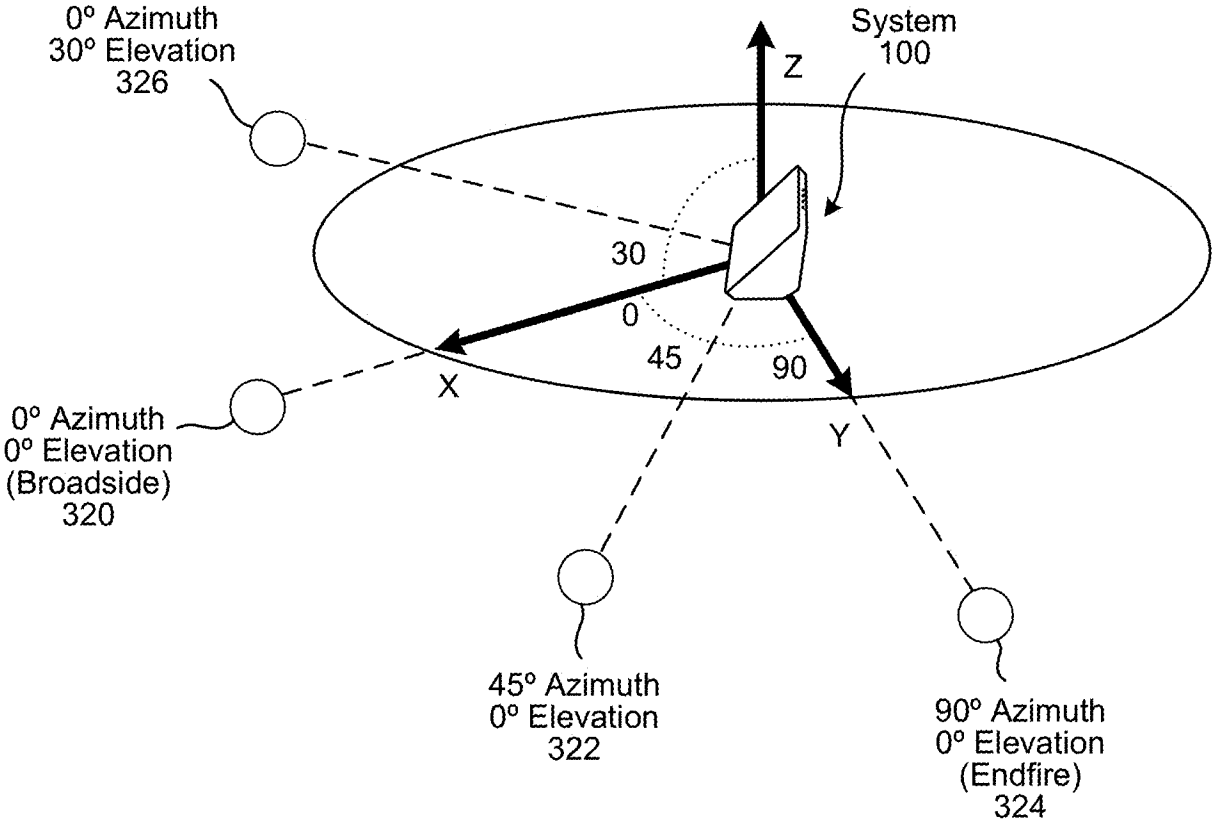

FIGS. 3A-3C illustrate placement of microphones on the system 100 and source of audio. Referring first to FIG. 3A, the first microphone array 102*a* includes a first microphone 310, a second microphone 312, a third microphone 314, and a fourth microphone 316 on the first plane 104*a*. The second microphone array 102*b* includes a fifth microphone 302, a sixth microphone 304, a seventh microphone 306, and an eighth microphone 308 on the second plane 104*b*. FIG. 3B illustrates a three-dimensional chart of the placement of the microphones 302, 304, 306, 308, 310, 312, 314, and 316. FIG. 3C illustrates various placements of audio sources 320-324; a first audio source 320 is disposed at 0° azimuth and 0° elevation (i.e., "broadside"); a second audio source 322 is disposed at 45° azimuth and 0° elevation; a third audio source 324 is disposed at 90° azimuth and 0° elevation (i.e., "endfire"); and a fourth audio source 326 is disposed at 0° azimuth and 30° elevation. As mentioned above, however, the present disclosure is not limited to only the particular number and placements described herein, and any number and/or placement of microphones on first and second (or additional) planes, as well as the placement of audio sources, is within the scope of the present disclosure.

Figure 4:
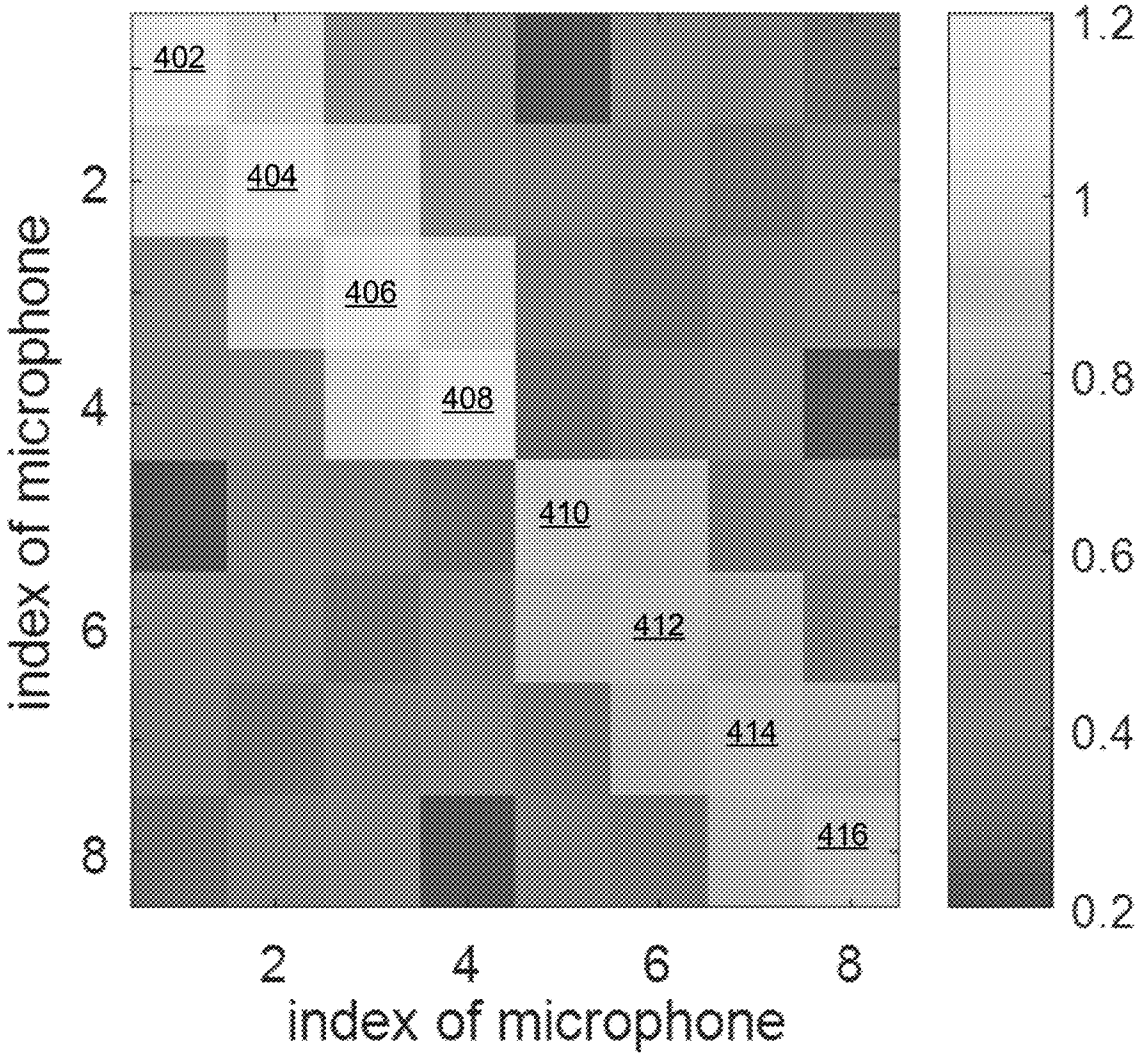
FIG. 4 illustrates a covariance matrix according to embodiments of the present disclosure.

FIG. 4 illustrates an example of a covariance matrix in accordance with embodiments of the present disclosure. Each covariance value of the covariance matrix is shaded to represent its value; lighter shading corresponds to a higher value (e.g., 1.2), and darker shading corresponds to a lower value (e.g., 0.2). As mentioned above, the $i^{th}$ column and the $j^{th}$ row of the covariance matrix corresponds to the spatial covariance between the $i^{th}$ microphone and the $j^{th}$ microphone in the arrays 102*a*, 102*b* of microphones. In existing systems, the values of the covariance matrix on its identity diagonal (e.g., (1,1), (2,2) . . . (n,n)) are defined as the value 1, indicating that a given microphone varies exactly with itself.

In embodiments of the present disclosure, a first set of diagonal values (e.g., a first diagonal value 402, a second diagonal value 404, a third diagonal value 406, and a fourth diagonal value 408) correspond to microphones in the first microphone array 102*a*. For example, the first diagonal 402 is at position (1,1) in the array and corresponds to a first microphone 310 in the first microphone array 102. A second set of diagonal values (e.g., a fifth diagonal value 410, a sixth diagonal value 412, a seventh diagonal value 414, and an eighth diagonal value CCD16) correspond to microphones in the second microphone array 102*b*. For example, the fifth diagonal 410 is at position (5,5) in the array and corresponds to a fifth microphone 302 in the second microphone array 102*b*.

In various embodiments, the diagonal covariance values corresponding to the first microphone array 102*a* differ from the diagonal covariance values corresponding to the second microphone array 102*b* (and/or each other). In some embodiments, for example, the diagonal covariance values 402, 404, 406, and 408 are 1.2, and the diagonal covariance values 410, 412, 414, and 416 are 0.8. The diagonal covariance values may thus differ from the default value, 1, by a similar deviation (0.2). The average covariance value of all the diagonal covariance values 402, 404, 406, 408, 410, 412, 414, and 416 may be 1. The present disclosure is not limited, however, to any particular set of differing diagonal covariance values or deviations, and any diagonal covariance values and deviations are within the scope of the present disclosure.

In the above example, the diagonal covariance values for the first array of microphones 102*a* are the same value (1.2), as are the diagonal covariance values for the second array of microphones 102*b* (0.8). In other embodiments, however, the diagonal covariance values for the first array of microphones 102*a* differ, as do the diagonal covariance values for the second array of microphones 102*b*. For example, the diagonal covariance values may be the same or similar if the microphones of each array 102*a*, 102*b* are spatially disposed close to each other; if, however, the microphones are spatially disclosed at a greater distance, the diagonal covariance values may differ accordingly. The covariance values of the covariance matrix may be determined via experimentation, simulation, or by any other such process. In some embodiments, default values are selected for the covariance values (e.g., all 1s), and the covariance values are determined by iteratively solving Equation (1). The deviation values may be determined during this process, by further experimentation, or by any other process.

In some embodiments, the deviation values correspond to the placement of the first and second microphone arrays 102*a*, 102*b*. For example, the positive deviation from 1, +0.2, may correspond to the first microphone array 102*a* being disposed as facing a speaker, while the negative deviation from 1, −0.2, may correspond to the second microphone array 102*b* being disposed as facing away from a speaker. This assignment of deviations may correspond to audio captured by the first microphone array 102*a* being given greater emphasis than audio captured by the second microphone array 102*b*. In various embodiments, audio captured by the first microphone array 102*a* includes fewer echoes, ambient noise, or other noise when compared to audio captured by the second microphone array 102*b*, and giving it greater emphasis by assigning a positive deviation aids in performing beamforming of the captured audio.

In various embodiments, a different covariance matrix may be determined for each of multiple frequency sub-bands. For example, a first covariance matrix is determined for frequencies between 20 Hz and 5 kHz; a second covariance matrix is determined for frequencies between 5 kHz and 10 kHz; a third covariance matrix is determined for frequencies between 10 kHz and 15 kHz; and a fourth covariance matrix is determined for frequencies between 15 kHz and 20 kHz. Any number of covariance matrices for any number or breakdown of frequency sub-bands is, however, within the scope of the present disclosure. Such specific frequency sub-band based covariance matrices may assist in describing the different ways the microphone positions impact audio in different ranges.

In some embodiments, one or more covariance matrices (e.g., frequency sub-band specific matrices) may be determined for different fixed beamforming positions. A fixed beamforming position may be, for example, 2 meters in front of the system at an elevation of 30 degrees with respect to the system. This fixed beamforming position may correspond to a typical use case of the system, in which a speaker is positioned at this position when interacting with the system. In other embodiments, however, further sets of covariance matrices are determined for a plurality of positions. For example, a first set of covariance matrices may be determined for the case in which the user is positioned in front of the system 100 (e.g., a "broadside" position), a second set of covariance matrices may be determine for the case in which the user is positioned at a 45 degree angle with respect to the first plane 104*a* of the system 100; and a third set of covariance matrices may be determined for the case in which the user is positioned at a 90 degree angle with respect to the first plane 104*a* of the system 100 (e.g., an "endfire" position). Further sets of covariance matrices may be determined based on the user being positioned at various elevations (e.g., positions in the Z dimension) with respect to the system 100 (e.g., 0 degrees, 30 degrees, and/or 45 degrees). The system 100 may determine that the user has uttered speech using, for example, voice-activity detection and/or wakeword detection) and, based on a determined position of the user, select a set of covariance matrices that best corresponds to the determined position. A first candidate covariance matrix may correspond to a first direction (e.g., a 45 degree angle with respect to the first plane 104*a* of the system 100), and a second candidate covariance matrix may correspond to a second direction (e.g., a 90 degree angle with respect to the first plane 104*a* of the system 100); the system may determine that the determined position of the user (e.g., an 80 degree angle with respect to the first plane 104*a* of the system 100) is closer to the second direction of the second covariance matrix and thus select the second covariance matrix.

Figure 5A:
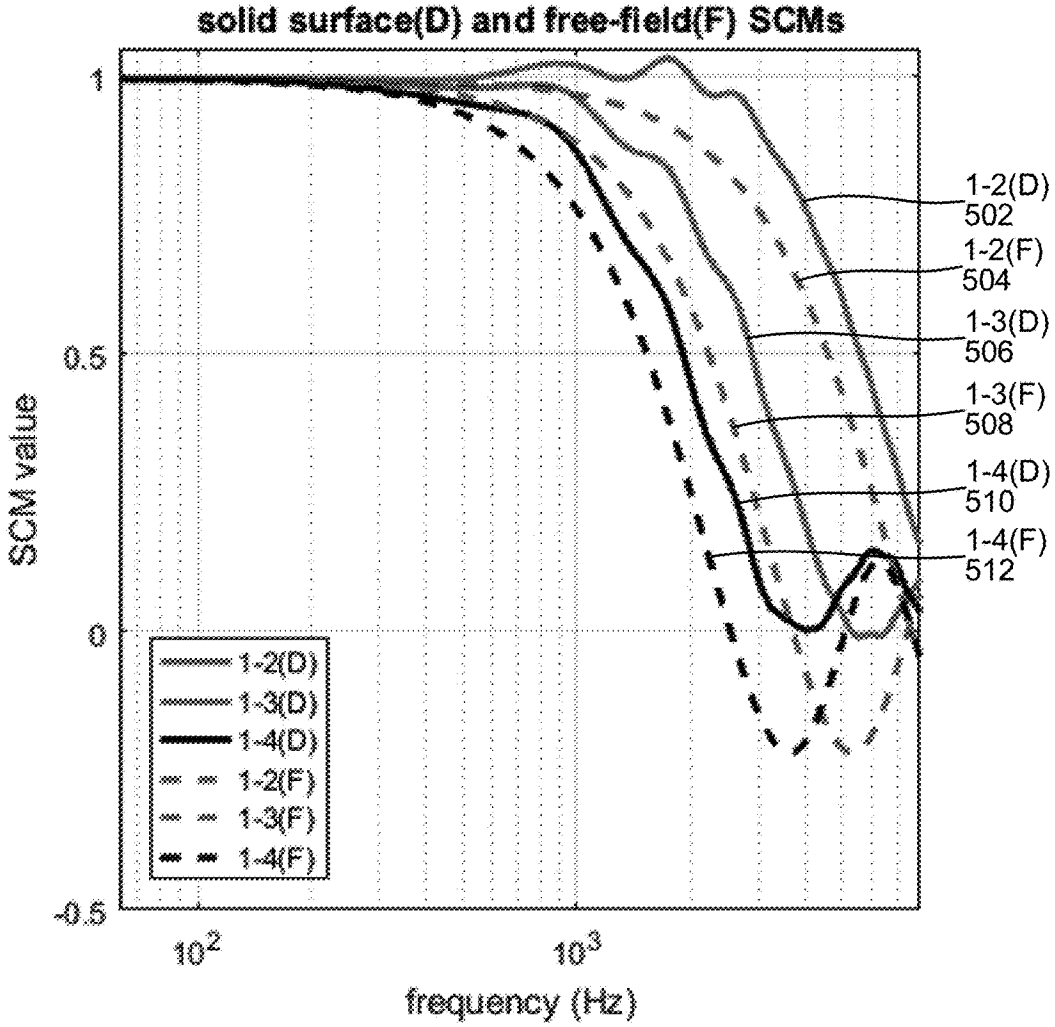
FIGS. 5A and 5B illustrate values of the covariance matrix according to embodiments of the present disclosure.
Figure 5B:
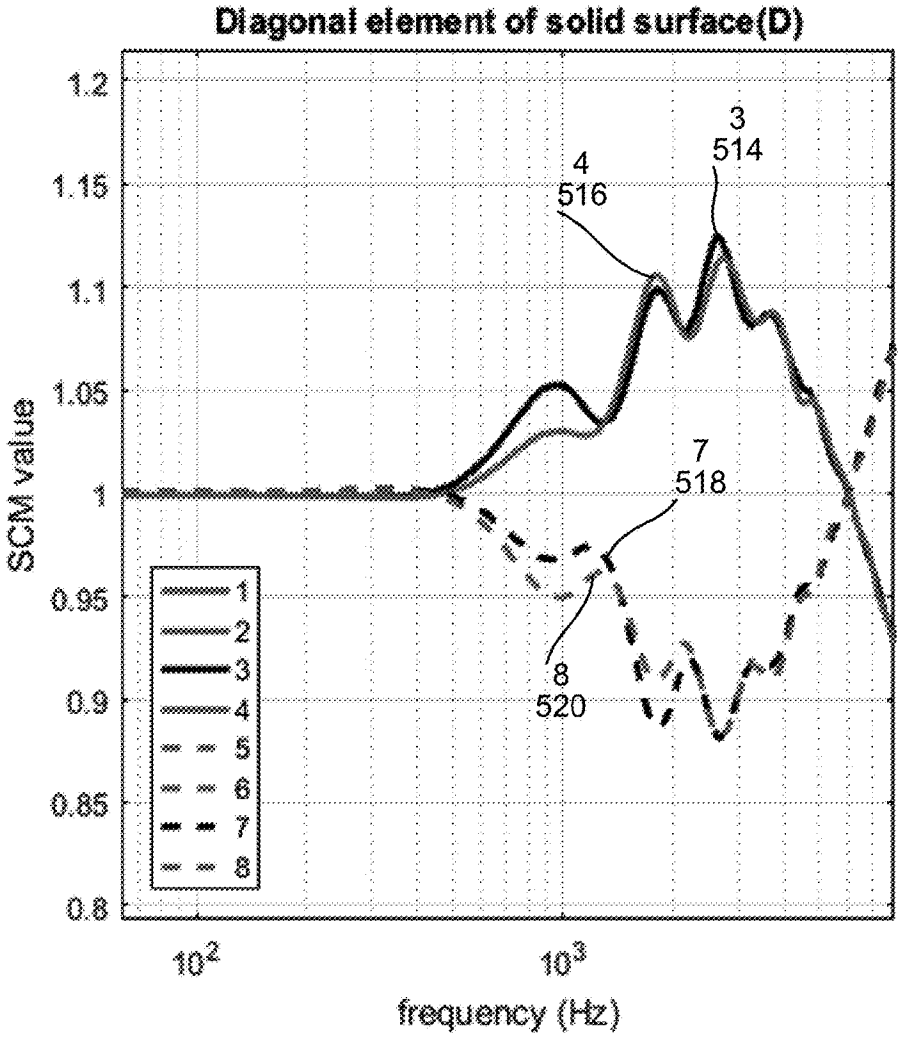

FIGS. 5A and 5B illustrate spatial covariance matrix values versus frequency. Referring first to FIG. 5A, a first curve 502 illustrates the spatial covariance matrix values between a first microphone (e.g., microphone 310) and a second microphone (e.g., microphone 312) for the system 100. As can be seen, the values of the first curve 502 are generally higher than those of a second curve 504 corresponding to the same microphones in a free-field simulation (e.g., in which the microphones are disposed in space at their corresponding positions with no intervening system 100) at frequencies generally above 1 kHz. Similarly, a third curve 506 illustrates spatial covariance matrix values for the first microphone and a third microphone (e.g., microphone 314), and a fourth curve 508 illustrates the corresponding free-field simulation. A fifth curve 510 illustrates spatial covariance between the first microphone and a fourth microphone (e.g., microphone 316), and sixth curve illustrates the corresponding free-field simulation.

FIG. 5B illustrates the diagonal element of the spatial covariance matrix for various microphones. For example, as described above, the diagonal element of the spatial covariance matrix may be generally greater than one for the first microphone array 102*a* and less than one for the second microphone array 102*b*. Thus, a first curve 514 illustrates the diagonal element corresponding to the third microphone is greater than one for frequencies greater than approximately 500 Hz, as does a second curve 516 corresponding to the fourth microphone. A fourth curve 418 corresponding to the seventh microphone is correspondingly less than one, as is a fourth curve 520 corresponding to the eighth microphone.

Figure 6A:
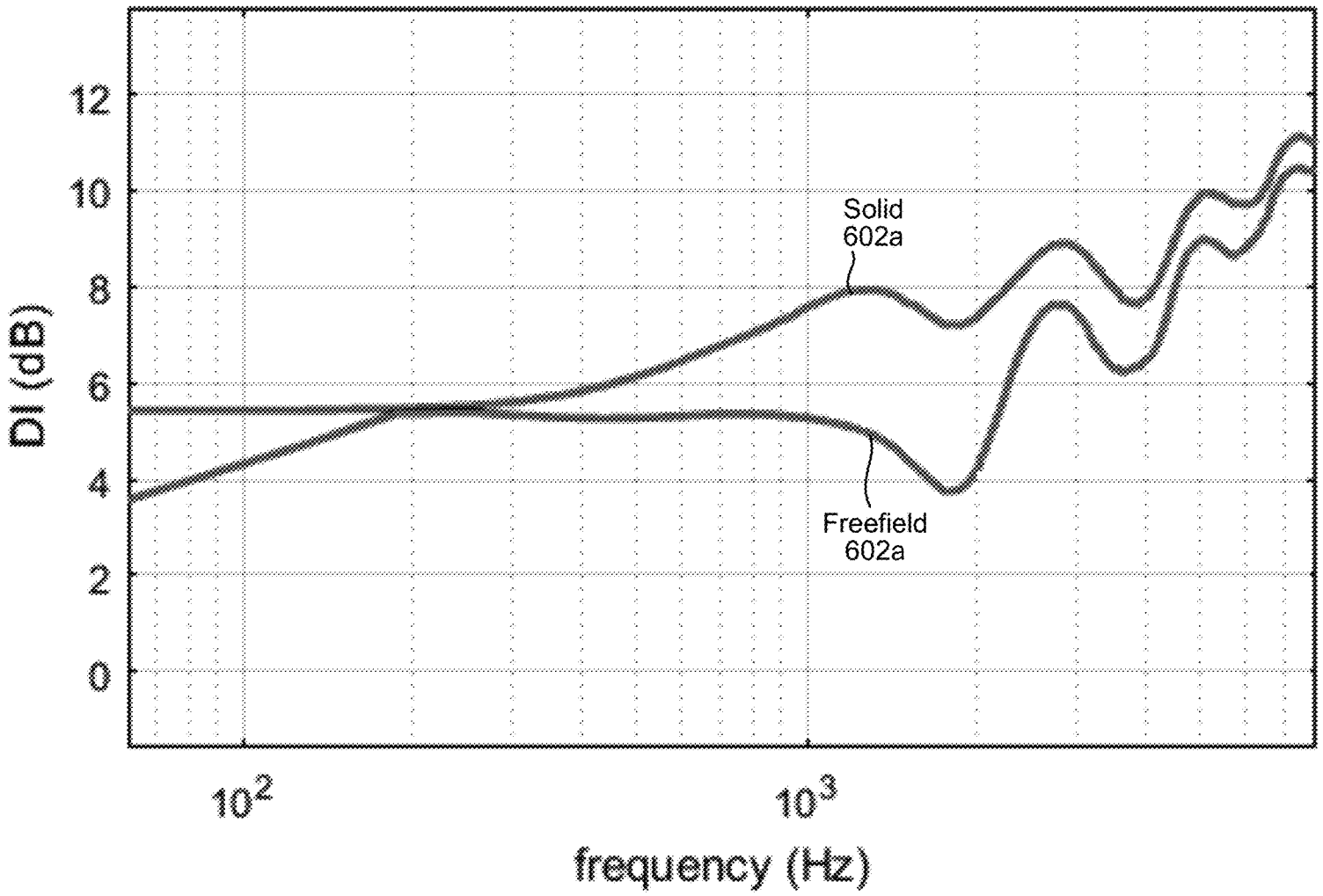
FIGS. 6A-6C illustrate directional-index values versus frequency at a first elevation according to embodiments of the present disclosure.
Figure 6B:
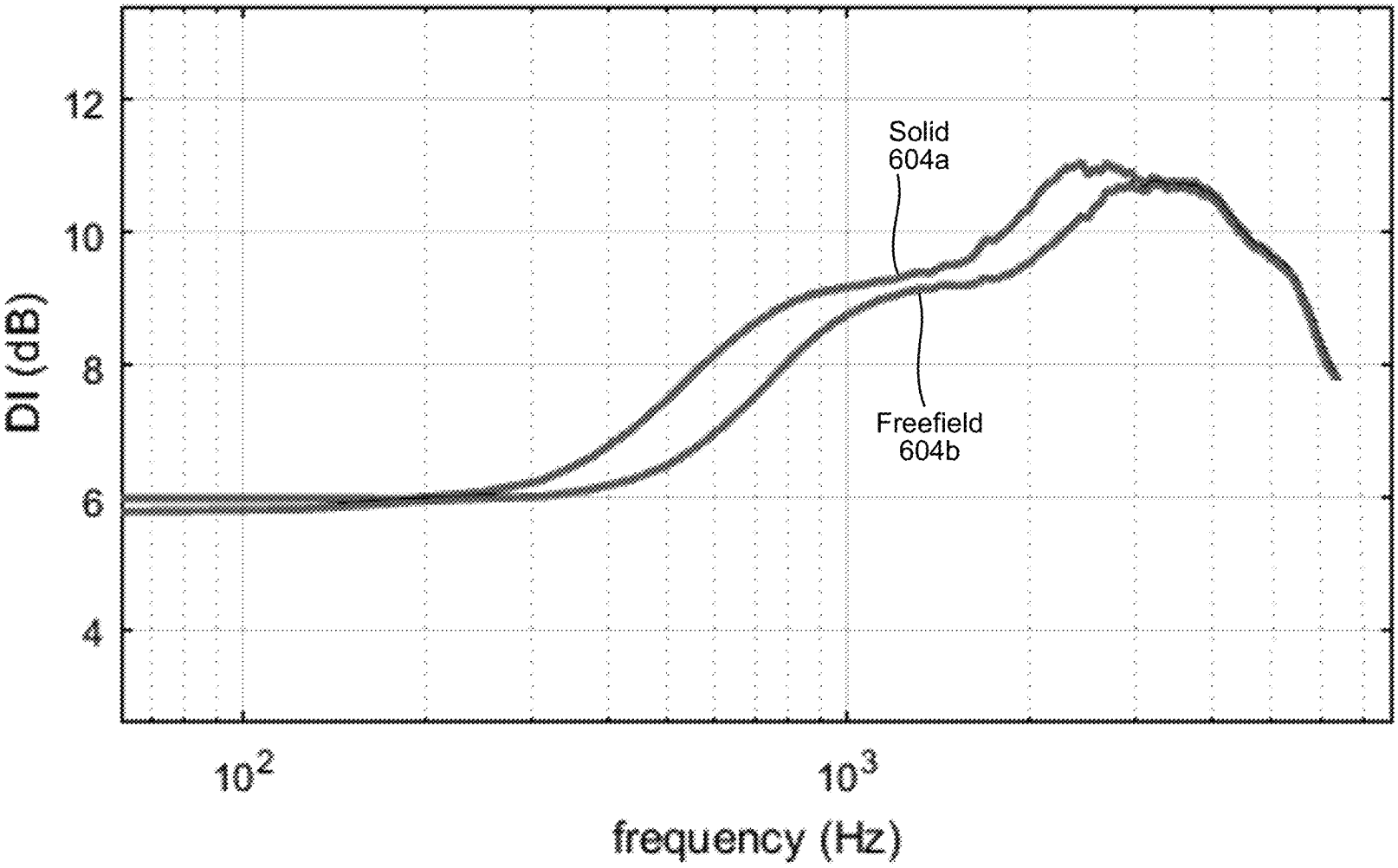
Figure 6C:
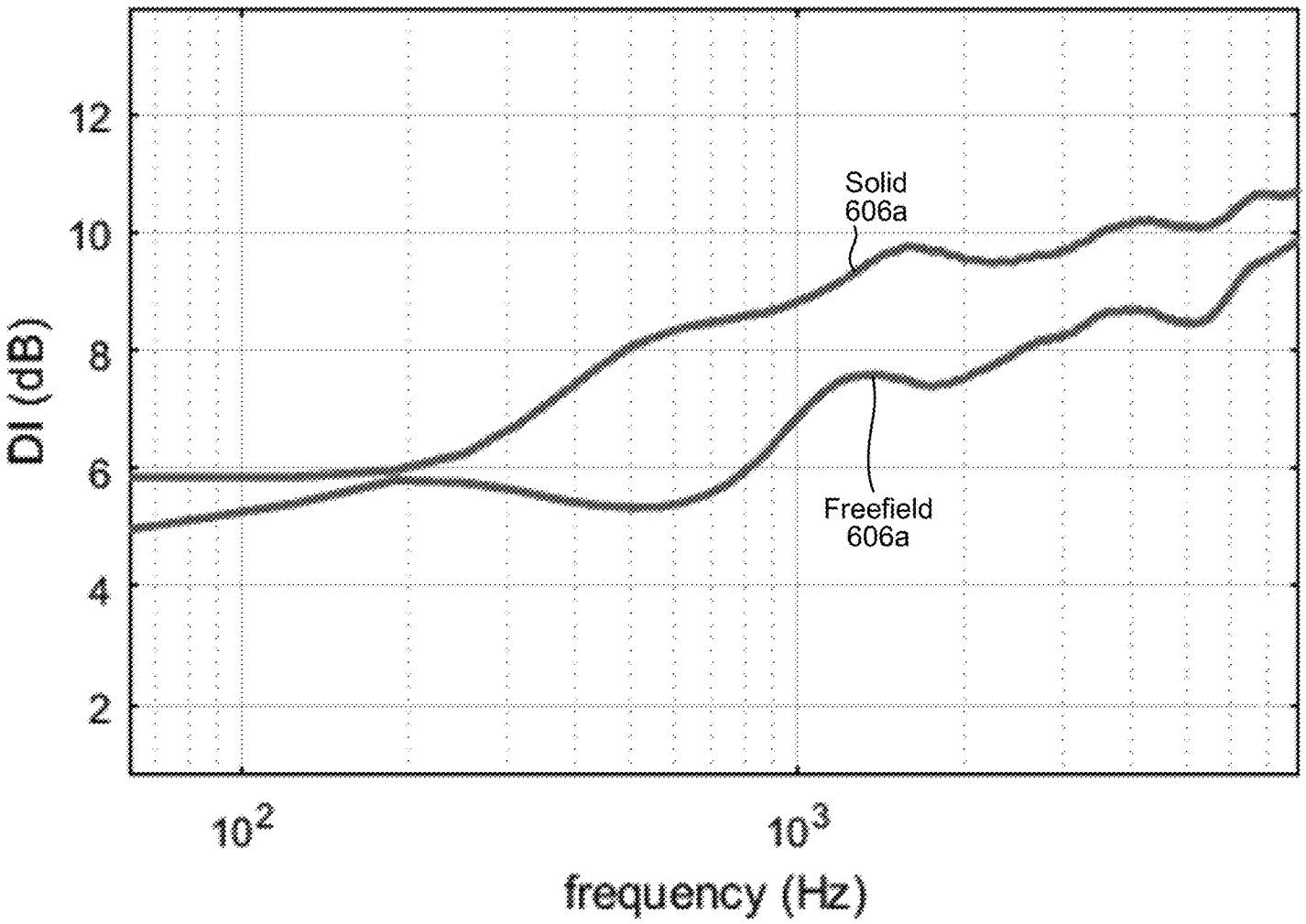
Figure 7A:
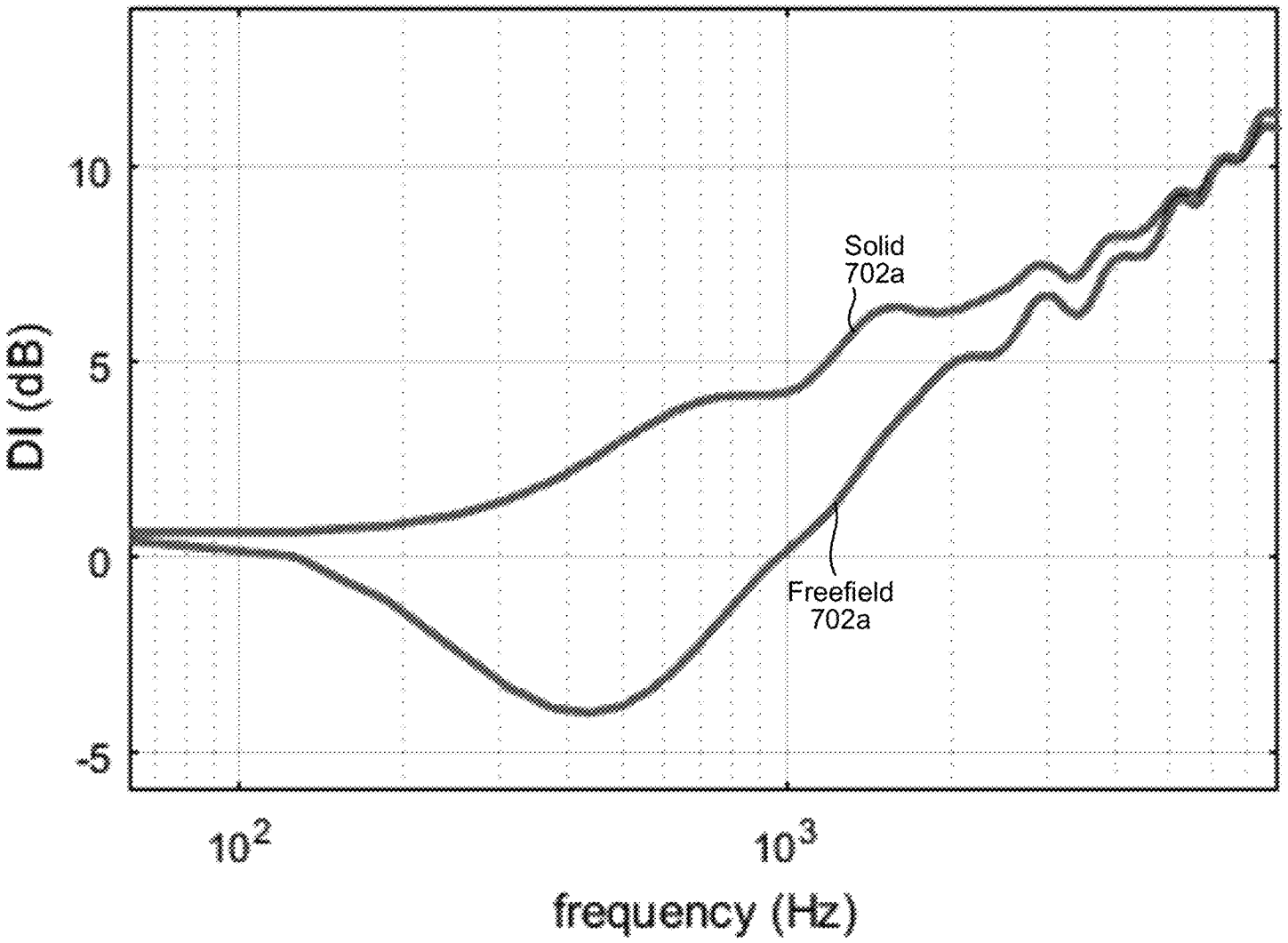
FIGS. 7A-7C illustrate directional-index values versus frequency at a second elevation according to embodiments of the present disclosure.
Figure 7B:
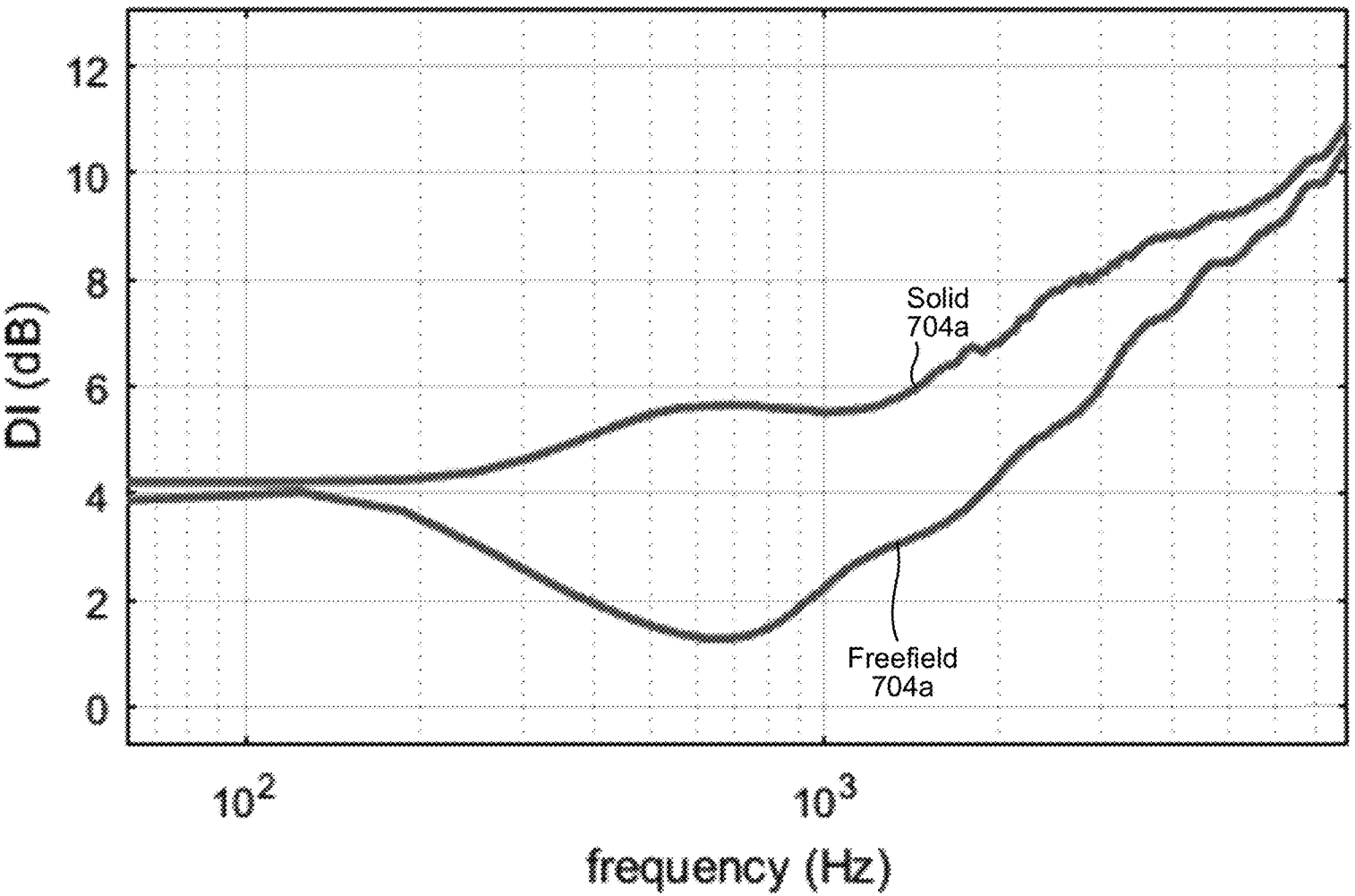
Figure 7C:
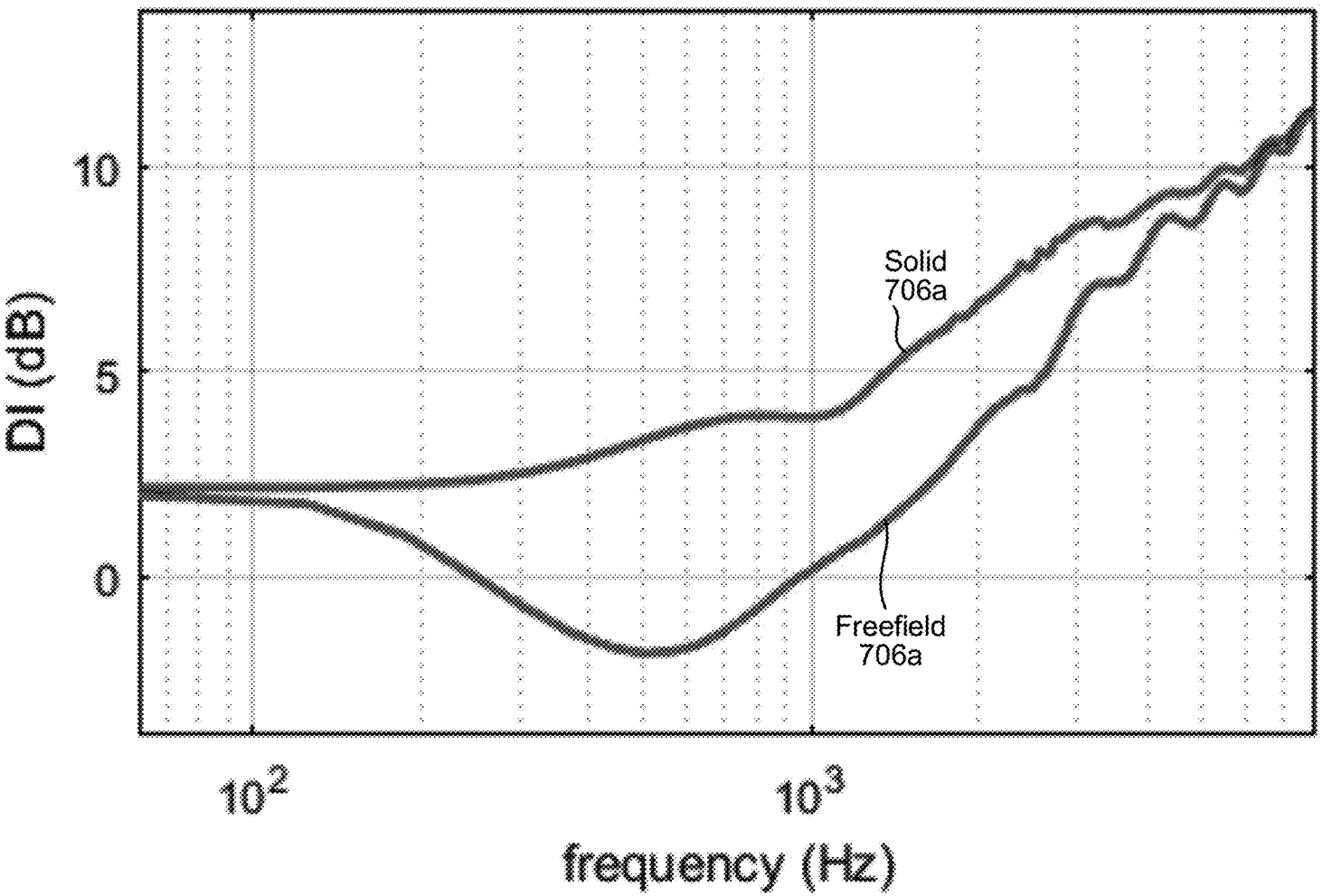

FIGS. 6A-6C and 7A-7C illustrate the directional index (DI) of the system 100 for various azimuth directions and elevations. The directional index is a metric corresponding to how well the system 100 differentiates between sounds coming from different directions (e.g., how well the beamforming components 204 boost audio from an intended direction), wherein a higher directional index corresponds to better differentiation. FIG. 6A illustrates a first DI curve 602*a* for the system 100 when the user is positioned directly in front of the system (e.g., "broadside") at an elevation of 0 degrees as compared to a second DI curve 602*b* for a corresponding free-field simulation; FIG. 6B illustrates a third DI curve 604*a* for the system 100 when the user is positioned at a 90 degree angle with respect to the first plane 104*a* (e.g., "endfire") at an elevation of 0 degrees as compared to a fourth curve 604*b* for a corresponding free-field simulation; and FIG. 6C illustrates a fifth DI curve 606*a* for the system 100 when the user is positioned at a 45 degree angle with respect to the first plane 104*a* at an elevation of 0 degrees as compared to a sixth curve 606*b* for a corresponding free-field simulation. FIGS. 7A-7C illustrate similar DI curves for broadside 702*a*, 702*b*, endfire 704*a*, 704*b*, and 45 degree 706*a*, 708*a* cases at an elevation of 30 degrees (as opposed to 0 degrees for FIGS. 6A-6C).

Figure 8A:
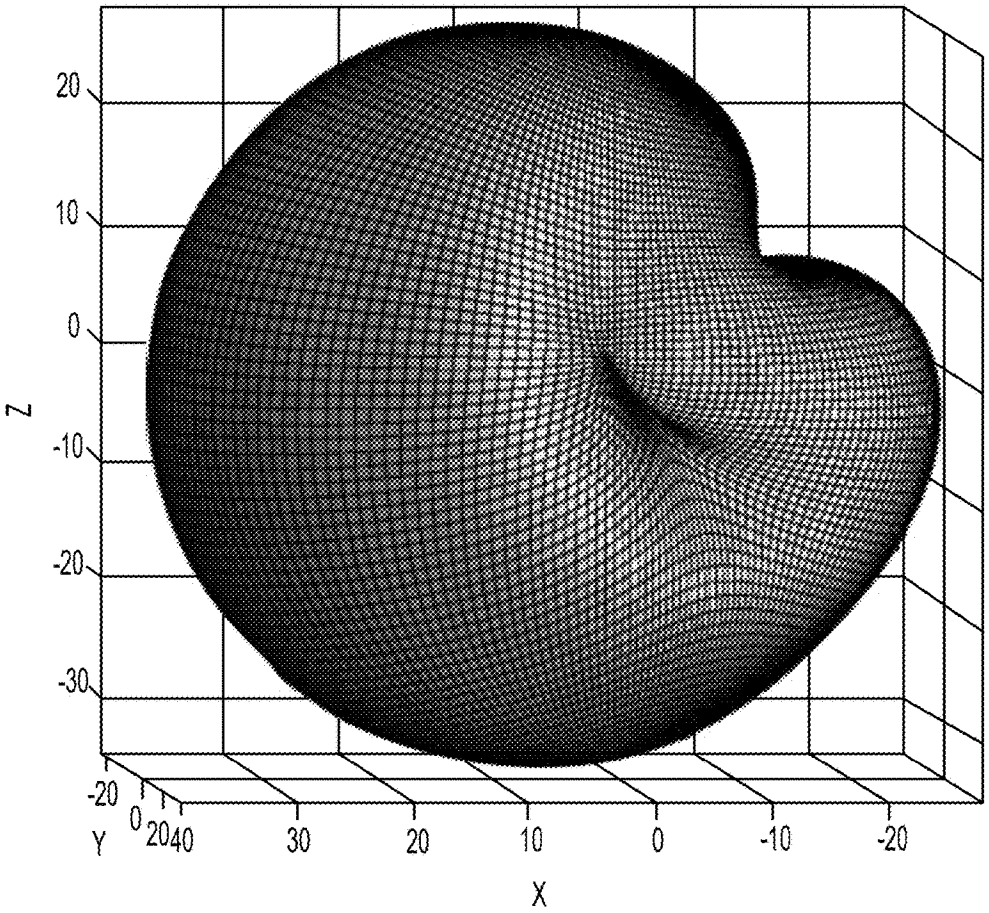
FIGS. 8A-8D illustrate three-dimensional frequency response plots according to embodiments of the present disclosure.
Figure 8B:
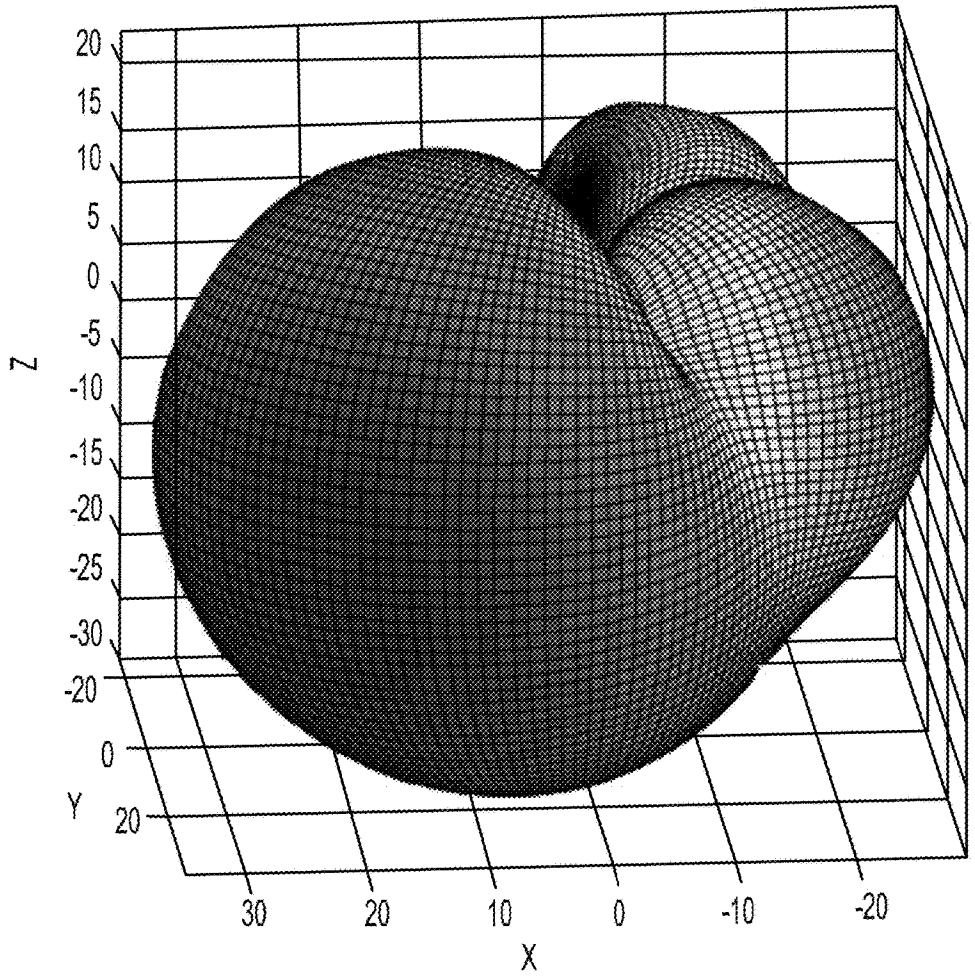
Figure 8C:
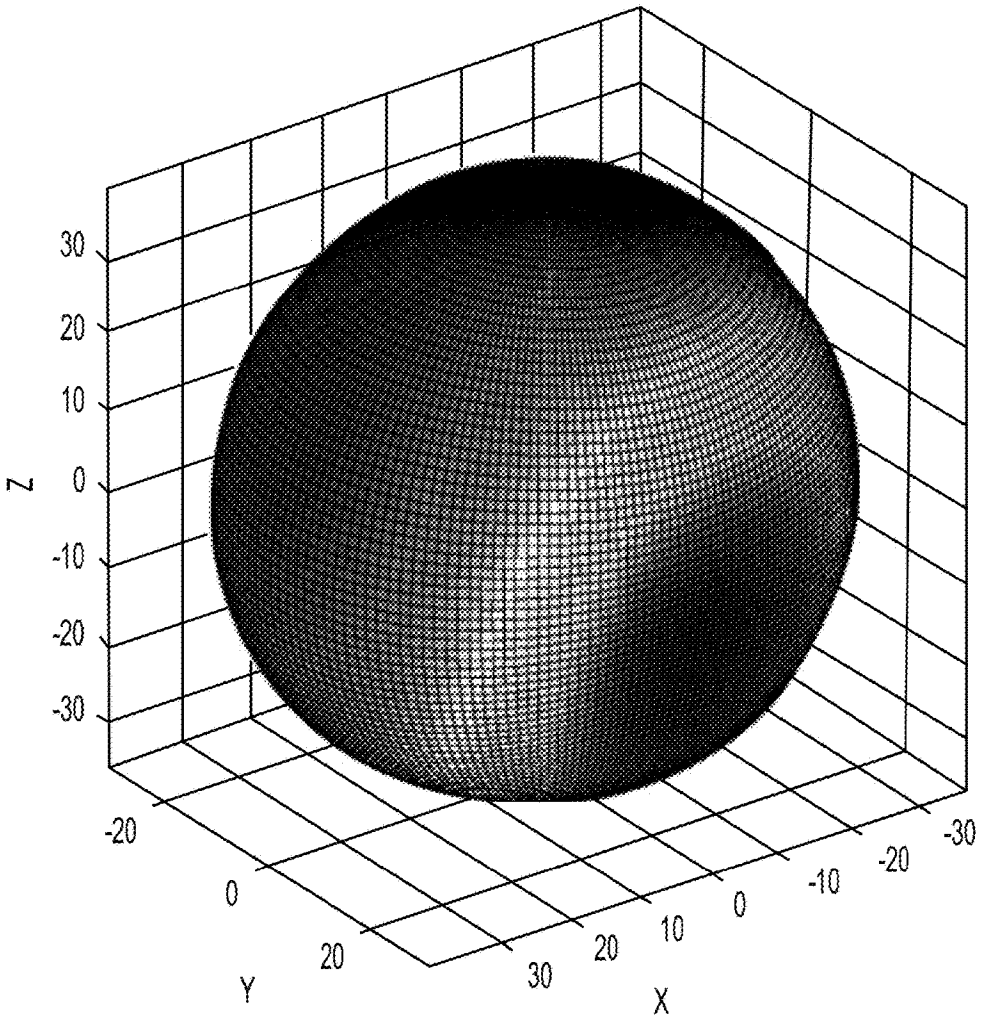
Figure 8D:
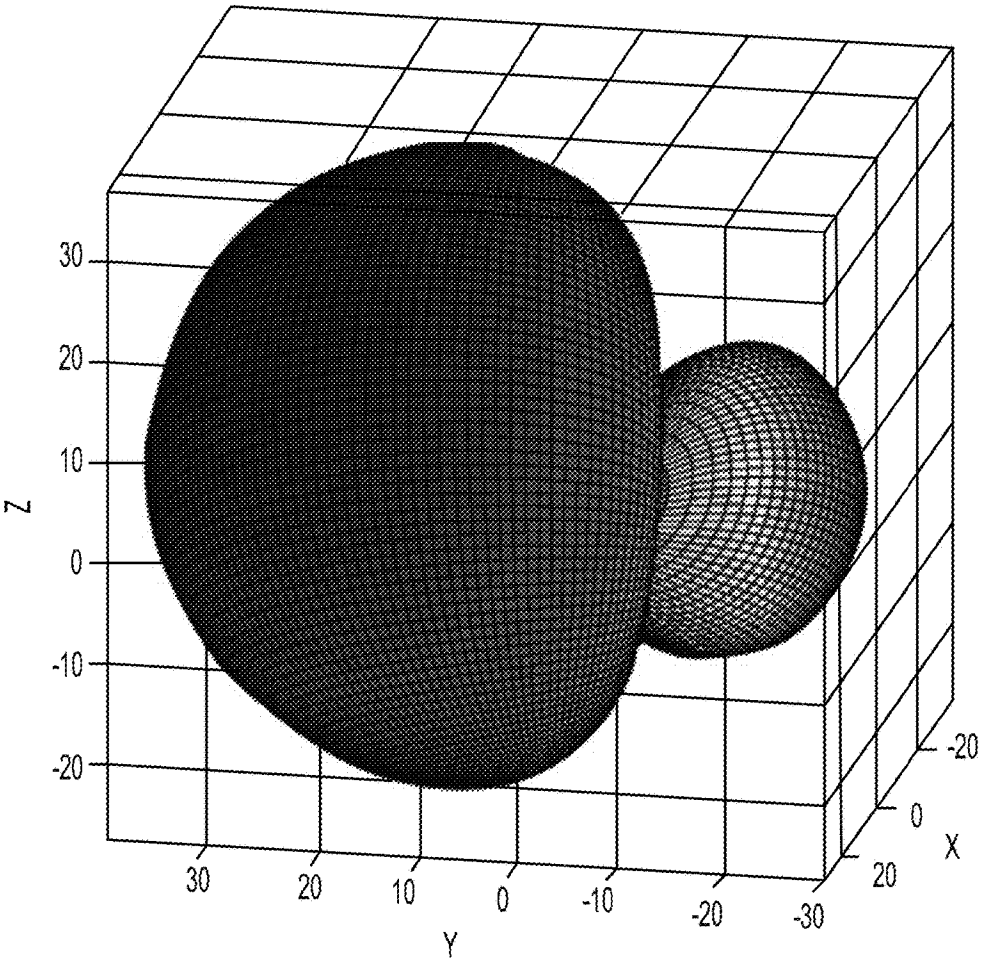

FIGS. 8A-8D illustrate three-dimensional frequency response plots for the system 100 at various azimuth directions, elevations, and frequencies. FIG. 8A is a three-dimensional frequency response plot for an azimuth direction of 0 degrees (e.g., directly in front of the system 100) and an elevation of 90 degrees at 1 kHz. FIG. 8B is a three-dimensional frequency response plot for an azimuth direction of 44 degrees and elevation of 90 degrees at 1 kHz. FIG. 8C is a three-dimensional frequency response plot for an azimuth direction of 0 degrees and an elevation of 30 degrees at 625 Hz. FIG. 8D is a three-dimensional frequency response plot for an azimuth direction of 90 degrees and an elevation of 30 degrees at 625 Hz.

Various machine learning techniques may be used to create the weight values of the covariance matrix. For example, a model may be trained to determine the weight values. Models may be trained and operated according to various machine learning techniques. Such techniques may include, for example, inference engines, trained classifiers, etc. Examples of trained classifiers include conditional random fields (CRF) classifiers, Support Vector Machines (SVMs), neural networks (such as deep neural networks and/or recurrent neural networks), decision trees, AdaBoost (short for "Adaptive Boosting") combined with decision trees, and random forests. In particular, CRFs are a type of discriminative undirected probabilistic graphical models and may predict a class label for a sample while taking into account contextual information for the sample. CRFs may be used to encode known relationships between observations and construct consistent interpretations. A CRF model may thus be used to label or parse certain sequential data, like query text as described above. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. For example, known types for previous queries may be used as ground truth data for the training set used to train the various components/models. Various techniques may be used to train the models including backpropagation, statistical learning, supervised learning, semi-supervised learning, stochastic learning, stochastic gradient descent, or other known techniques. Thus, many different training examples may be used to train the classifier(s)/model(s) discussed herein. Further, as training data is added to, or otherwise changed, new classifiers/models may be trained to update the classifiers/models as desired.

Figure 9:
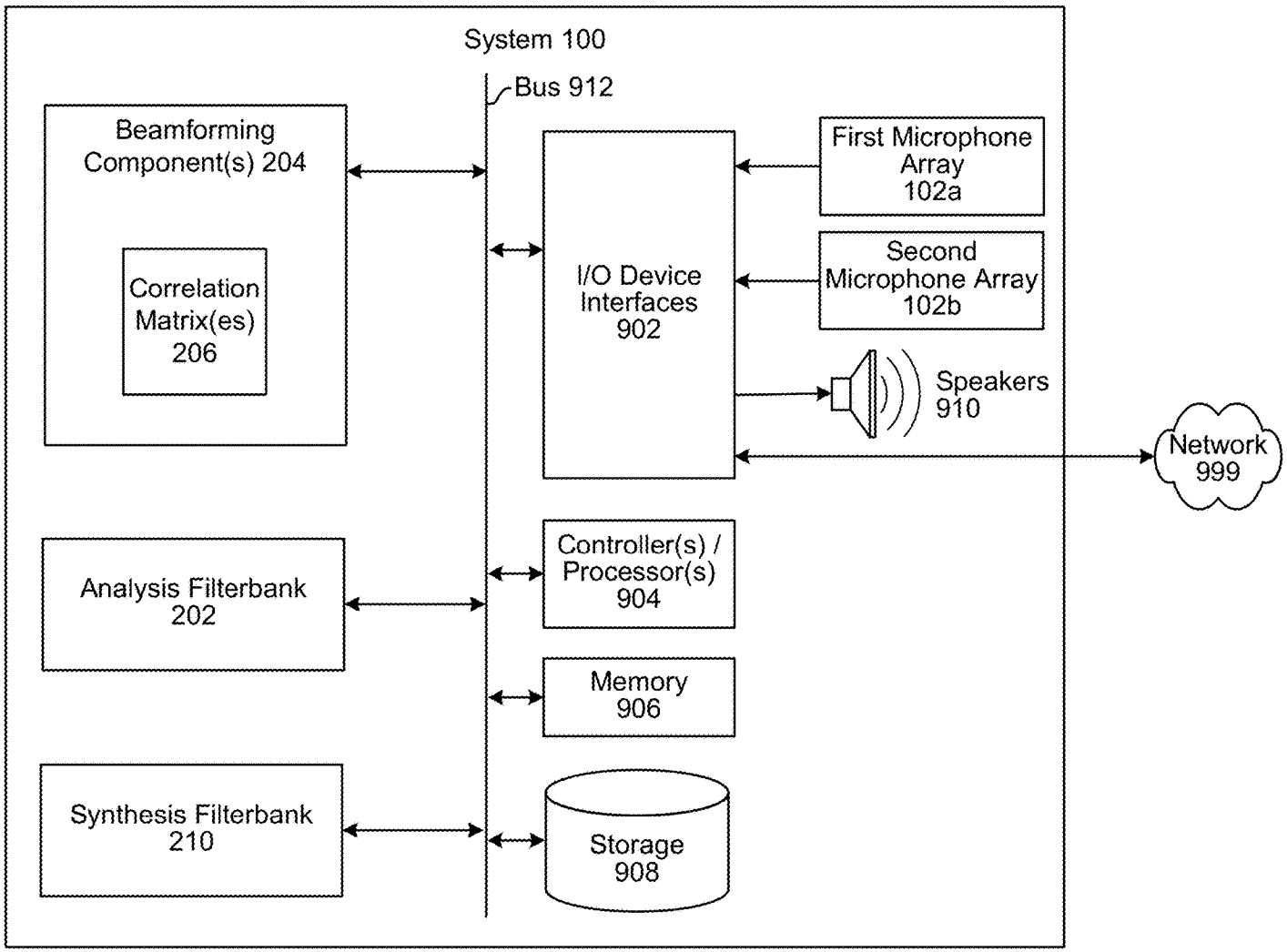
FIG. 9 is a block diagram conceptually illustrating example components of a system for beamforming according to embodiments of the present disclosure.

FIG. 9 is a block diagram conceptually illustrating example components of the system 100. In operation, the system 100 may include computer-readable and computer-executable instructions that reside on the system, as will be discussed further below. The system 100 may include one or more audio capture device(s), such as a first microphone array 102*a* and a second microphone array 102*b*, each of which may include a plurality of microphones. The audio capture device(s) may be integrated into a single device or may be separate. The system 100 may also include an audio output device for producing sound, such as speaker(s) 910. The audio output device may be integrated into a single device or may be separate. The system 100 may include an address/data bus 912 for conveying data among components of the system 100. Each component within the system may also be directly connected to other components in addition to (or instead of) being connected to other components across the bus 912.

The system 100 may include one or more controllers/processors 904, which may each include a central processing unit (CPU) for processing data and computer-readable instructions, and a memory 906 for storing data and instructions. The memory 906 may include volatile random access memory (RAM), non-volatile read only memory (ROM), non-volatile magnetoresistive (MRAM) and/or other types of memory. The system 100 may also include a data storage component 908, for storing data and controller/processor-executable instructions (e.g., instructions to perform operations discussed herein). The data storage component 908 may include one or more non-volatile storage types such as magnetic storage, optical storage, solid-state storage, etc. The system 100 may also be connected to removable or external non-volatile memory and/or storage (such as a removable memory card, memory key drive, networked storage, etc.) through the input/output device interfaces 902.

Computer instructions for operating the system 100 and its various components may be executed by the controller(s)/processor(s) 904, using the memory 906 as temporary "working" storage at runtime. The computer instructions may be stored in a non-transitory manner in non-volatile memory 906, storage 908, and/or an external device. Alternatively, some or all of the executable instructions may be embedded in hardware or firmware in addition to or instead of software.

The system 100 may include input/output device interfaces 902. A variety of components may be connected through the input/output device interfaces 902, such as the speaker(s) 910, the microphone arrays 102*a*/102*b*, and a media source such as a digital media player (not illustrated). The input/output interfaces 902 may include A/D converters (not shown) and/or D/A converters (not shown).

The system may include one or more beamforming components 204, which may each include one or more covariance matrix(es) 206, analysis filterbank 202, synthesis filterbank 210, and/or other components for performing the processes discussed above.

The input/output device interfaces 902 may also include an interface for an external peripheral device connection such as universal serial bus (USB), FireWire, Thunderbolt or other connection protocol. The input/output device interfaces 902 may also include a connection to one or more networks 999 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 999, the system 100 may be distributed across a networked environment.

Multiple devices may be employed in a single system 100. In such a multi-device system, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system. For example, certain components, such as the beamforming components 204, may be arranged as illustrated or may be arranged in a different manner, or removed entirely and/or joined with other non-illustrated components.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the beamforming component 204 may, for example, be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A device comprising:

at least one processor;

a first microphone array disposed on a front-facing plane of the device, the first microphone array comprising a first microphone and a second microphone;

a second microphone array disposed on a top-facing plane of the device, the second microphone array comprising a third microphone and a fourth microphone, the top-facing plane of the device being orthogonal to the front-facing plane of the device; and at least one memory including instructions that, when executed by the at least one processor, cause the device to:

receive, from the first microphone, a first audio signal corresponding to an utterance by a user;

receive, from the second microphone, a second audio signal corresponding to the utterance;

receive, from the third microphone, a third audio signal corresponding to the utterance;

receive, from the fourth microphone, a fourth audio signal corresponding to the utterance;

determine, using a Fast Fourier Transform (FFT), a frequency-domain signal by combining the first audio signal, the second audio signal, the third audio signal, and the fourth audio signal;

perform, using a 4x4 spatial covariance matrix (SCM), minimum variance distortionless response (MVDR) beamforming on the frequency-domain signal to create a beamformed frequency-domain signal, wherein the SCM comprises:

a first plurality of non-diagonal values, wherein each non-diagonal value corresponds to a spatial covariance between the first, second, third, or fourth microphone and a different microphone of the first, second, third, and fourth microphones, and a second plurality of diagonal values, wherein each diagonal value corresponds to a spatial covariance between each of the first, second, third, and fourth microphones and itself, wherein first diagonal values corresponding to the first microphone array are equal to 1.2 and wherein second diagonal values corresponding to the second microphone array are equal to 0.8; and determine, based on the beamformed frequency-domain signal, a beamformed time-domain audio signal.

2. The device of claim 1, wherein the at least one memory further includes instructions that cause the device to:

receive, from the first microphone, a fifth audio signal corresponding to a second utterance by the user and to noise from a noise source, the user disposed at an azimuth direction and a first elevation relative to the device, the noise source disposed at the azimuth direction and a second elevation, different from the first elevation, relative to the device;

receive, from the second microphone, a sixth audio signal corresponding to the second utterance and noise;

receive, from the third microphone, a seventh audio signal corresponding to the second utterance and noise;

receive, from the fourth microphone, an eighth audio signal corresponding to the second utterance and noise;

determine, using the FFT, a second frequency-domain signal by combining the fifth audio signal, the sixth audio signal, the seventh audio signal, and the eighth audio signal; and perform, using the 4×4 spatial covariance matrix (SCM), minimum variance distortionless response (MVDR) beamforming on the second frequency-domain signal to create a second beamformed frequency-domain signal, wherein the second beamformed frequency-domain signal corresponds to a boosted representation of the second utterance and to a suppressed representation of the noise.

3. The device of claim 1, wherein the at least one memory further includes instructions that cause the device to:

determine that a position of the user corresponds to a 0 degree azimuth direction and a 30 degree elevation with respect to the device; and select the SCM based at least in part on determining that the SCM includes values selected to isolate audio signals from the position.

4. The device of claim 1, further comprising performing, using a second SCM, MVDR beamforming on a frequency sub-band of the at least one frequency-domain signal, wherein the second SCM comprises:

a third plurality of non-diagonal values, wherein each non-diagonal value corresponds to a spatial covariance between the first, second, third, or fourth microphone and a different microphone of the first, second, third, and fourth microphones; and a fourth plurality of diagonal values, wherein each diagonal value corresponds to a spatial covariance between each of the first, second, third, and fourth microphones and itself, wherein third diagonal values corresponding to the first microphone array are equal to 1.1 and wherein fourth diagonal values corresponding to the second microphone array are equal to 0.9.

5. A computer-implemented method comprising:

receiving, from a first microphone of a first microphone array disposed on a first plane, a first audio signal corresponding to an acoustic event;

receiving, from a second microphone of the first microphone array disposed on a first plane, a second audio signal corresponding to the acoustic event;

receiving, from a third microphone of a second microphone array disposed on a second plane different from the first plane, a third audio signal corresponding to the acoustic event;

receiving, from a fourth microphone of the second microphone array disposed on the second plane, a fourth audio signal corresponding to the acoustic event;

determining a frequency-domain signal corresponding to a combination of the first audio signal, the second audio signal, the third audio signal, and the fourth audio signal;

processing the frequency-domain signal using a covariance matrix to create a beamformed frequency-domain signal, wherein the covariance matrix comprises:

a first covariance value corresponding to a diagonal of the covariance matrix, wherein the first covariance value corresponds to the first microphone array, and a second covariance value corresponding to the diagonal of the covariance matrix, wherein the second covariance value corresponds to the second microphone array and is different from the first covariance value; and determining an output audio signal corresponding to the beamformed frequency-domain signal.

6. The computer-implemented method of claim 5, further comprising:

determining a direction of a source of the acoustic event; and selecting the covariance matrix based at least in part on the direction.

7. The computer-implemented method of claim 6, further comprising:

determining a first direction corresponding to a first candidate covariance matrix;

determining a second direction corresponding to a second candidate covariance matrix;

determining that the direction is closer to the first direction than to the second direction; and selecting the first candidate covariance matrix as the covariance matrix.

8. The computer-implemented method of claim 5, wherein an average covariance value corresponding to covariance values of the diagonal of the covariance matrix is 1.

9. The computer-implemented method of claim 5, wherein:

the first microphone array comprises a first four microphones, the second microphone array comprises a second four microphones, and a size of the covariance matrix is 8×8.

10. The computer-implemented method of claim 5, wherein the first covariance value is greater than 1 and the second covariance value is less than 1.

11. The computer-implemented method of claim 5, wherein the first microphone array comprises a first four microphones, the second microphone array comprises a second four microphones, each covariance value of the covariance matrix corresponding to the first four microphones are each equal to the first covariance value, and each covariance value of the covariance matrix corresponding to the second four microphones are each equal to the second covariance value.

12. The computer-implemented method of claim 5, wherein creating the beamformed frequency-domain signal further comprises:

applying a second covariance matrix to a frequency sub-band corresponding to the frequency-domain signal, wherein the second covariance matrix comprises:

a third covariance value corresponding to a diagonal of the second covariance matrix, wherein the third covariance value is different from the first covariance value and corresponds to the first microphone array; and a fourth covariance value corresponding to the diagonal of the second covariance matrix, wherein the fourth covariance value is different from the second covariance value and corresponds to the second microphone array.

13. A device comprising:

at least one processor;

a first microphone array disposed on a first plane of the device, the first microphone array comprising a first microphone and a second microphone;

a second microphone array disposed on a second plane of the device, the second plane different from the first plane, the second microphone array comprising a third microphone and a fourth microphone; and at least one memory including instructions that, when executed by the at least one processor, cause the device to:

receive, from the first microphone, a first audio signal corresponding to an acoustic event;

receive, from the second microphone, a second audio signal corresponding to the acoustic event;

receive, from the third microphone, a third audio signal corresponding to the acoustic event;

receive, from the fourth microphone, a fourth audio signal corresponding to the acoustic event;

determine a frequency-domain signal corresponding to a combination of the first audio signal, the second audio signal, the third audio signal, and the fourth audio signal;

process the frequency-domain signal using a covariance matrix to create a beamformed frequency-domain signal, wherein the covariance matrix comprises:

a first covariance value corresponding to a diagonal of the covariance matrix, wherein the first covariance value corresponds to the first microphone array, and a second covariance value corresponding to the diagonal of the covariance matrix, wherein the second covariance value corresponds to the second microphone array and is different from the first covariance value; and determine an output audio signal corresponding to the beamformed frequency-domain signal.

14. The device of claim 13, wherein the at least one memory includes instructions that further cause the device to:

determine a direction of a source of the acoustic event; and select the covariance matrix based at least in part on the direction.

15. The device of claim 13, wherein the at least one memory includes instructions that further cause the device to:

determine a first direction corresponding to a first candidate covariance matrix;

determine a second direction corresponding to a second candidate covariance matrix;

determine that the direction is closer to the first direction than to the second direction; and select the first candidate covariance matrix as the covariance matrix.

16. The device of claim 13, wherein an average covariance value corresponding to covariance values of the diagonal of the covariance matrix is 1.

17. The device of claim 13, wherein:

the first microphone array comprises a first four microphones, the second microphone array comprises a second four microphones, and a size of the covariance matrix is 8×8.

18. The device of claim 13, wherein the first covariance value is greater than 1 and the second covariance value is less than 1.

19. The device of claim 13, wherein the first microphone array comprises a first four microphones, the second microphone array comprises a second four microphones, each covariance value of the covariance matrix corresponding to the first four microphones are each equal to the first covariance value, and each covariance value of the covariance matrix corresponding to the second four microphones are each equal to the second covariance value.

20. The device of claim 13, wherein the at least one memory includes instructions that further cause the device to:

applying a second covariance matrix to a frequency sub-band corresponding to the frequency-domain signal, wherein the second covariance matrix comprises:

a third covariance value corresponding to a diagonal of the second covariance matrix, wherein the third covariance value is different from the first covariance value and corresponds to the first microphone array; and a fourth covariance value corresponding to the diagonal of the second covariance matrix, wherein the fourth covariance value is different from the second covariance value and corresponds to the second microphone array.

* * * * *